US006631918B2

(12) United States Patent
Silva

(10) Patent No.: US 6,631,918 B2
(45) Date of Patent: Oct. 14, 2003

(54) GLIDING BOARD, SUCH AS A SKI, AND A GLIDING BOARD EQUIPPED WITH A BOOT-RETAINING ASSEMBLY

(75) Inventor: Gilles Silva, Le Montcel (FR)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 09/912,335

(22) Filed: Jul. 26, 2001

(65) Prior Publication Data

US 2002/0014757 A1 Feb. 7, 2002

(30) Foreign Application Priority Data

Jul. 28, 2000 (FR) ..... 00 10090

(51) Int. Cl.[7] ..... A63C 5/14
(52) U.S. Cl. ..... 280/607; 280/610; 280/617
(58) Field of Search ..... 280/607, 609, 280/610, 617, 618, 636

(56) References Cited

U.S. PATENT DOCUMENTS

| | | | | |
|---|---|---|---|---|
| 4,067,593 A | * | 1/1978 | Earl | 280/617 |
| 4,300,786 A | * | 11/1981 | Alley | 280/602 |
| 4,697,820 A | * | 10/1987 | Hayashi et al. | 280/609 |
| 4,697,821 A | * | 10/1987 | Hayashi et al. | 280/609 |
| 4,714,267 A | | 12/1987 | Abondance et al. | |
| 4,754,989 A | * | 7/1988 | Hoelzl | 280/602 |
| 4,913,455 A | | 4/1990 | Salsetti et al. | |
| 5,280,943 A | | 1/1994 | Commier et al. | |
| 5,366,234 A | * | 11/1994 | Rohrmoser | 280/610 |
| 5,393,085 A | * | 2/1995 | Forneri | 280/602 |
| 5,393,086 A | * | 2/1995 | Masson et al. | 280/602 |
| 5,397,150 A | * | 3/1995 | Commier et al. | 280/607 |
| 5,435,588 A | * | 7/1995 | Commier et al. | 280/602 |
| 5,447,322 A | * | 9/1995 | Masson et al. | 280/602 |
| 5,655,787 A | * | 8/1997 | Piegay | 280/607 |
| 5,690,349 A | | 11/1997 | Rohrmoser | |
| 5,871,223 A | * | 2/1999 | Zanco | 280/607 |
| 5,884,934 A | * | 3/1999 | DeRocco et al. | 280/607 |
| 5,915,717 A | * | 6/1999 | Faye | 280/602 |
| 6,217,055 B1 | * | 4/2001 | Silva | 280/607 |
| 6,227,558 B1 | * | 5/2001 | Arduin et al. | 280/611 |
| 6,412,807 B1 | | 7/2002 | Arduin et al. | 280/607 |

FOREIGN PATENT DOCUMENTS

| | | |
|---|---|---|
| EP | 0167462 | 1/1986 |
| EP | 0332546 | 9/1989 |
| EP | 0465794 | 1/1992 |
| EP | 0677306 | 10/1995 |
| FR | 2785823 | 5/2000 |

* cited by examiner

*Primary Examiner*—Brian L. Johnson
*Assistant Examiner*—Bridget Avery
(74) *Attorney, Agent, or Firm*—Greenblum & Bernstein, P.L.C.

(57) ABSTRACT

An alpine including a longitudinal beam having front and rear ends and a central zone, the beam being formed by a main core covering a running surface, a stack of gliding and reinforcing layers with two lateral running edges, the core itself being covered by a stack of reinforcing, and possibly decorating layers. In the central zone, a secondary core is superposed on the main core so as to form, in this central zone, a projecting rib having a reduced width. An interface with a plate for supporting the retaining elements is provided to be assembled to the ski by journals.

26 Claims, 4 Drawing Sheets

1
2
3
4
5
6
7
8
10
11
12
13
14
16
18
19
21
22
25
26
27
28
30
31
II
III
IV
V 4
45
53
51
58
43
49
47
42
40
41
50
44

4
45
55
58
59
8
47
50
43
49
41
42
40
44

8
56
58
59
47
30
53
4
45
43
49
41
42
50
40
44

8
55
58
59
53
49
50
4
45
43
47
42
40
41
44

GLIDING BOARD, SUCH AS A SKI, AND A GLIDING BOARD EQUIPPED WITH A BOOT-RETAINING ASSEMBLY

CROSS-REFERENCE TO RELATED APPLICATIONS

This application is based upon French Patent Application No. 00 10090, filed Jul. 28, 2000, the disclosure of which is hereby incorporated by reference thereto in its entirety, and the priority of which is hereby claimed under 35 U.S.C. §119.

BACKGROUND OF THE INVENTION

1. Field of the Invention

The present invention relates to a gliding apparatus, such as a snow ski. In a known fashion, such an apparatus is used with another similar apparatus so as to form a pair, and it includes a board provided to rest and glide on a gliding surface and, above the board, retaining elements provided to retain one of the skier's boots.

The invention also relates to a ski equipped with an assembly for retaining the boot, i.e., a binding.

2. Description of Background and Relevant Information

In the case of skis, the boards generally have a shovel, which is a turned up and rounded front end, as well as a tail, which is a slightly turned up trimmed rear end.

In certain cases, a central zone of the ski is provided with at least one member for anchoring the assembly for retaining the boot, which enables the ski to bend freely with respect to the boot An example is disclosed in document FR 2 785 823. According to this document, the anchoring member has a first portion through which an opening extends, the opening having an axis oriented along a transverse direction of the ski, and a second portion through which an opening also extends, his opening also having an axis oriented along the transverse direction of the ski.

However, the pressure exerted by the ski on the snow has a peak in the area of each anchoring zone.

SUMMARY OF THE INVENTION

An object of the invention is to ensure that the distribution of pressure along the central zone of the ski is more uniform.

The ski according to the invention includes a longitudinal beam having front and rear ends and a central zone, the beam being formed by a main core covering a running surface, a stack of gliding and reinforcing layers with two lateral running edges, the core itself being covered by a stack of reinforcing layers and, possibly, decorating layers. In the central zone, a secondary core is superposed on the main core so as to form, in this central zone, a projecting rib having a reduced width.

The rib increases the thickness of the ski both in the area of the portions and between the portions of the anchoring member. As a result, the pressure distribution along the central zone of the ski is more uniform.

This advantageously makes the steering of the ski more precise on trajectories with small radii of curvature.

The pressure distribution along the central zone of the ski is more uniform.

The skiing assembly according to the invention includes a ski, such as previously defined, overlaid by a plate having front and rear mounting plates provided for retaining elements and connected to the ski by two transverse journals.

BRIEF DESCRIPTION OF DRAWINGS

Other characteristics and advantages of the invention will be better understood from the description that follows, with reference to the annexed drawings showing, by way of non-limiting examples, how the invention can be embodied, and in which.

DETAILED DESCRIPTION OF THE INVENTION

Figure 1:
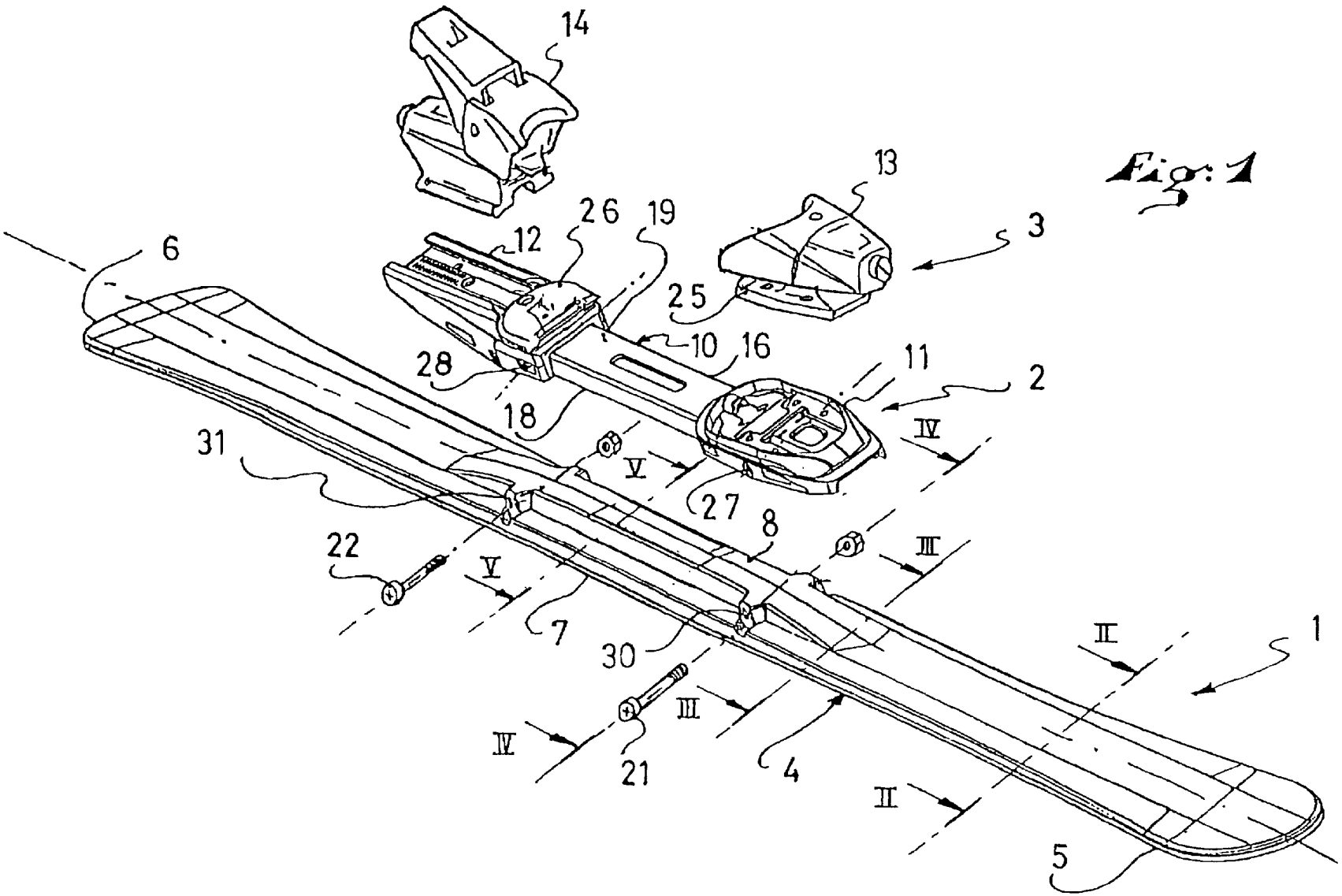
FIG. 1 is an exploded perspective view of an assembly including a ski and an interface device provided to receive an assembly for retaining a boot according to the invention.
Figure 2:
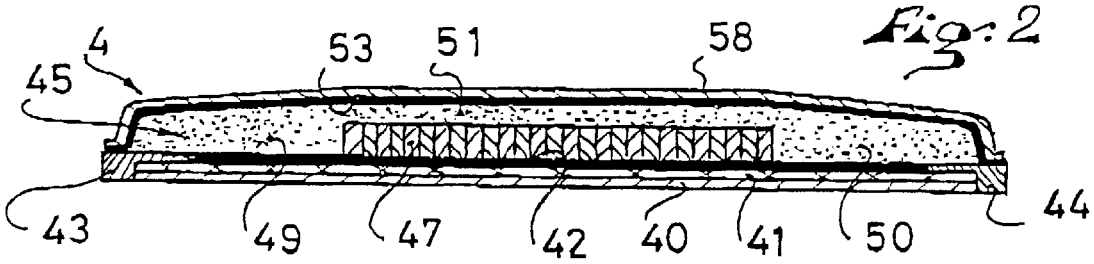
FIG. 2 is a cross-section along the line II—II of FIG. 1.
Figure 3:
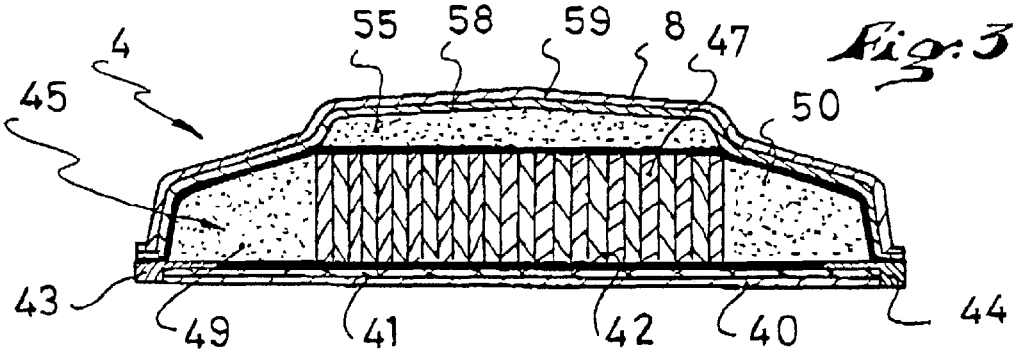
FIG. 3 is a cross-section along the line III—III of FIG. 1
Figure 4:
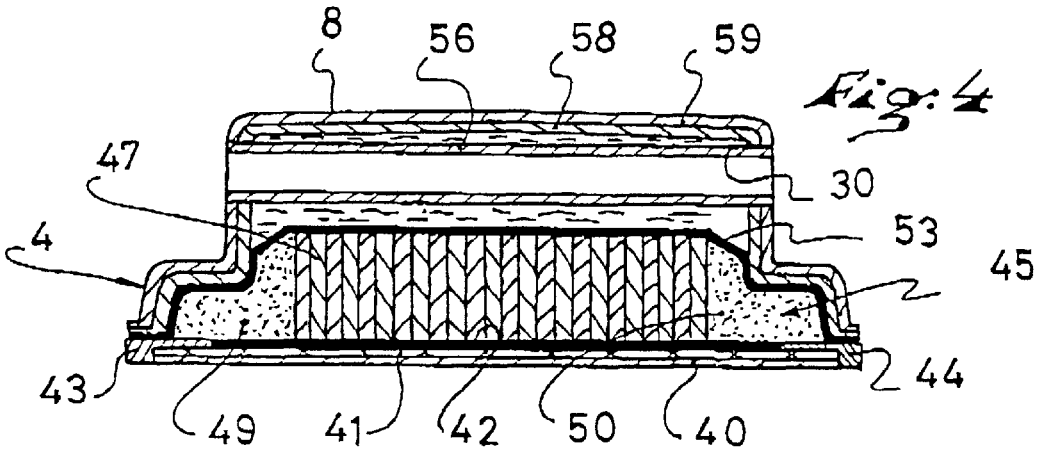
FIG. 4 is a cross-section along the line IV—IV of FIG. 1.
Figure 5:
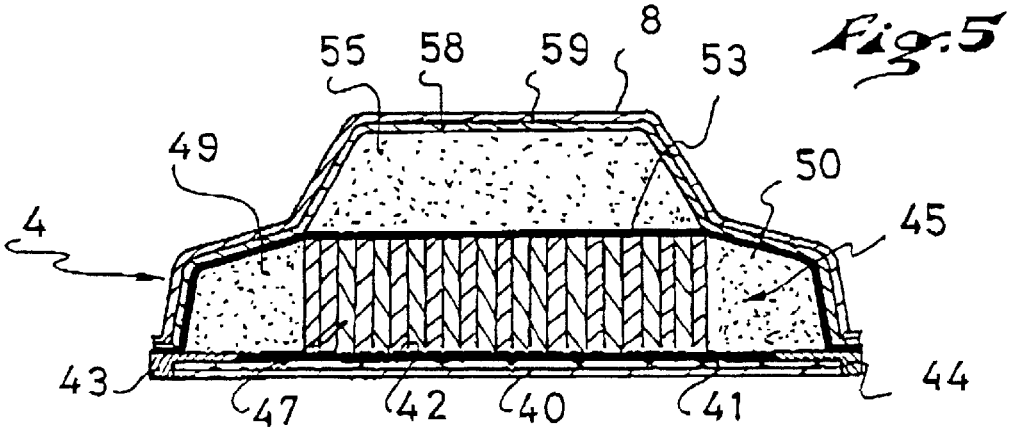
FIG. 5 is a cross-section along the line V—V of FIG. 1.

FIG. 1 shows, by way of illustration of the invention, a ski 1 overlaid by an interface device 2 and an assembly 3 for retaining the boot on the ski.

The ski is formed by a lower beam 4 elongated along a longitudinal direction, whose front end 5 is rounded and turned up to form a shovel, and the rear end 6 is trimmed and slightly turned up to form the tail.

In a known fashion, the beam is cambered and, when at rest and supported on a flat surface, it rests on two support lines that are slightly set back with respect to the shovel and to the tail. The central zone 7 of the ski has a camber oriented upwardly with respect to these two support lines.

For example, the beam has a length of about 1950 millimeters, and a width of about 120 millimeters at the shovel 5, 90 millimeters in the central zone 7, and 115 millimeters at the tail 6. Preferably, the central zone 7, which is spaced longitudinally from the front and rear ends 5, 6, of the beam, is not quite in the middle of the ski; it is slightly offset toward the rear. These particular values are exemplary and are not to be considered as limiting the invention; the beam could be constructed with different measurements.

In its central zone 7, the beam is overlaid by an upwardly projecting longitudinal rib 8. The thickness of the rib 8 preferably varies progressively in continuity with the thickness of the beam. Also, as shown in the figure, the rib has a reduced width with respect to the width of the beam in this zone.

Lengthwise, the rib covers at least the entire central zone of the ski where the interface device 2 and the retaining elements are assembled. It also extends rearwardly and forwardly of this zone to cover between one half and one third of the length of the ski, or approximately one half.

The interface device 2 is in the form of elongated rigid plate 10 with mounting plates 11 and 12 provided for front and rear retaining elements 13 and 14. These elements are of a known type and are not described in detail herein.

The mounting plates 11 and 12 of the plate 10 are connected by a rigid central member or bar 16.

Laterally, the elongated plate 10 has two flanges 18, 19 which are provided to extend downwardly along the lateral surfaces of the rib.

The interface device 2 is assembled to the ski 1 by two transverse journals 21, 22 which extend through the rib and the flanges 18 and 19.

The journals are located in the area of the support elements 25 and 26 of the retaining elements 13 and 14 which are provided to support the front and rear ends of the boot They extend through the flanges 18 and 19 in the area of the two bores 27 and 28, and through the rib in the area of two through housings 30 and 31 located in the zone of maximum thickness of the rib. The plate and the rib are provided such that once mounted on the ski, the plate is raised with respect to the upper surface of the ski. Possibly, filtering cushions made of elastomer, for example, can be inserted between the plate and the ski.

The journals, for example, are screw/nut assemblies or pins, or another fixing elements that enable a relative pivoting movement between the plate and the ski over a limited amplitude.

According to the embodiment shown, the width of the rib is locally increased in the area of the housings 30 and 31, to provide two lateral surfaces for supporting and guiding the flanges. The inner spacing of the flanges is equal to the distance between the lateral surfaces, except for the operational clearance. Also preferably, the bore 28 of the device 2 is longitudinally oblong to enable the ski to bend. However, the other bore, or one of the housings of the ski, could also be made oblong.

FIGS. 2–5 show the ski 1 in cross-section, in the areas of the cross-sectional planes II—II, III—III, IV—IV, V—V, referenced respectively in FIG. 1.

The beam 4 of the ski generally has a conventional structure, with a lower sub-assembly formed by a lowermost layer 40 providing a running, or gliding, surface 40, a lower reinforcing layer 41 made of resin-impregnated fibers, and a lower metallic reinforcing layer 42 made, for example, of aluminum alloy. This sub-assembly is laterally edged with two running edges 43 and 44 which preferably overlap slightly with respect to the lateral sides of the ski.

A main core 45 extends above this sub-assembly. According to the embodiment shown, the core is made of foam, in particular polyurethane foam, with a wooden insert.

The wooden insert 47 extends over a reduced width and over the entire length of the beam of the ski. The wooden insert rests on the lower metallic reinforcing layer 42. It is made of slats, for example, of various species glued to one another.

Laterally, the wooden insert is edged with portions 49, 50 made, for example, of polyurethane foam. On the front and rear of the rib 31, the wooden insert is covered with a foam portion 51 that continuously connects the two lateral portions 49 and 50.

For example, the main core is obtained from a foam cake that is machined to create a groove in which the wooden insert is housed.

The portions 49, 50, 51 of the main core 45 define the outer shape of the ski at the front, at the rear, and on each side of the rib 8. As can be seen in the figures, the side walls of the ski are slightly inclined. The upper surfaces of the portions 49 and 50 are also inclined from the base up toward the longitudinal median plane of the ski, except in the area of the housings 30 and 31 where they are recessed to clear the entrance of the housings.

According to the embodiment shown, the main core 45 of the beam of the ski is covered by a metallic reinforcing layer 53 which extends over the entire length of the beam. Preferably, the metallic reinforcing layer descends laterally along the sides of the ski, down to the rung edges 43 and 44, and covers the overlapping portion of the running edges. This is not limiting, and the metallic layer could be interrupted so as to be set back from the running edges. Also, the layer could extend far, more or less, toward the running edges in various longitudinal portions of the ski.

In the area of the rib 8, the metallic reinforcing layer 53 is covered with a secondary core 55 made of polyurethane foam, for example, which provides the shape of the of the rib. For example, the secondary core has a length of 800 millimeters, a width of 50 millimeters, and a maximum height of 12 milimeters. These values are not lifting, and the secondary core could be made with other dimensions. The secondary core rests on the metallic reinforcing layer 53. Advantageously, it has substantially the same width as the wooden insert 47 of the main core 45 on which it is superposed. In the area of the housings 30, the secondary core is widened and has two lateral surfaces erected perpendicular to the bottom surface of the ski. Optionally, it is reinforced by an insert 56, which is, for example, a tube made of a plastic material such as fiber-reinforced polyurethane. The same is true for the other housing 31.

An upper reinforcing layer 58 made of resin-impregnated fibers covers the beam and secondary core assembly 55. This layer descends laterally down to the running edges to form the outer shell of the ski. Preferably, the local reinforcing layer 58 covers the overlapping portion of the running edges and of the metallic reinforcing layer.

The zone of the rib 8 is then coated with a lap 59 of resin-impregnated fibers which forms a second local reinforcing layer, and which extends laterally along the lateral sides of the rib and of the beam, down to the running edges to locally form a shell in the area of the rib.

In an alternative embodiment, the local reinforcing layer 59 could be placed beneath the upper reinforcing layer 58.

Possibly, an external decorating layer is superposed on the assembly. This layer is not shown in the figures.

The various reinforcing layers and the cores are assembled to one another by any appropriate means known to a person with ordinary skill in the art, in particular by intercalary adhesive films.

The linkage between the ski and the interface device enables the ski to bend along a uniform curvature, in particular in the central zone of the ski, due to the journals about which the ski can pivot over a low amplitude. The forces coming from the plate are transmitted by the journals and are recovered by the rib 8 which distributes them in the entire central zone of the ski.

In this way, due to the rib 8 and to the fact that the rib is superposed, and supported, on the wooden insert of the main core, a more uniform distribution of the pressure on the ski is obtained.

An advantage associated with this more uniform distribution is that the steering of the ski is more accurate on trajectories with small radii of curvature.

Moreover, the two superposed shells formed by the layers 58 and 59 ensure a good transmission of the forces between the journals 21, 22 and the running edges.

Figure 6:
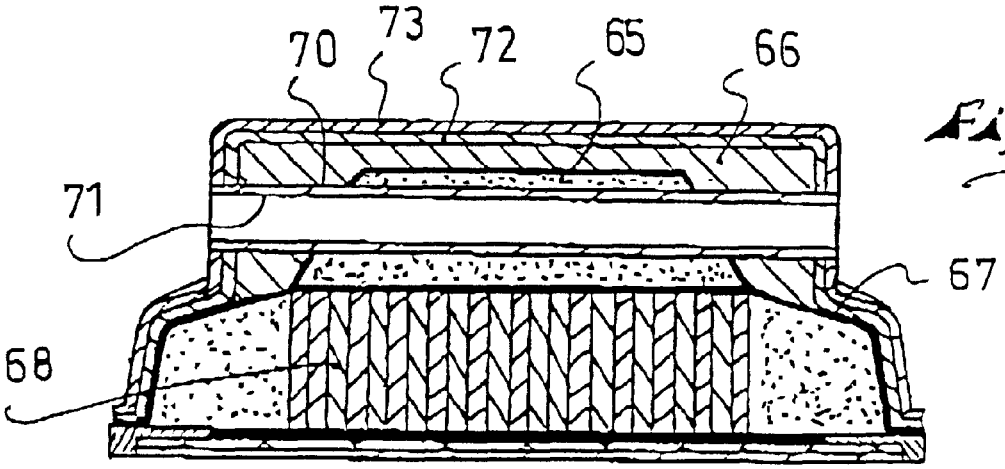
FIG. 6 relates to an alternative embodiment and shows the ski in a transverse cross-section in the area of a through housing.
Figure 7:
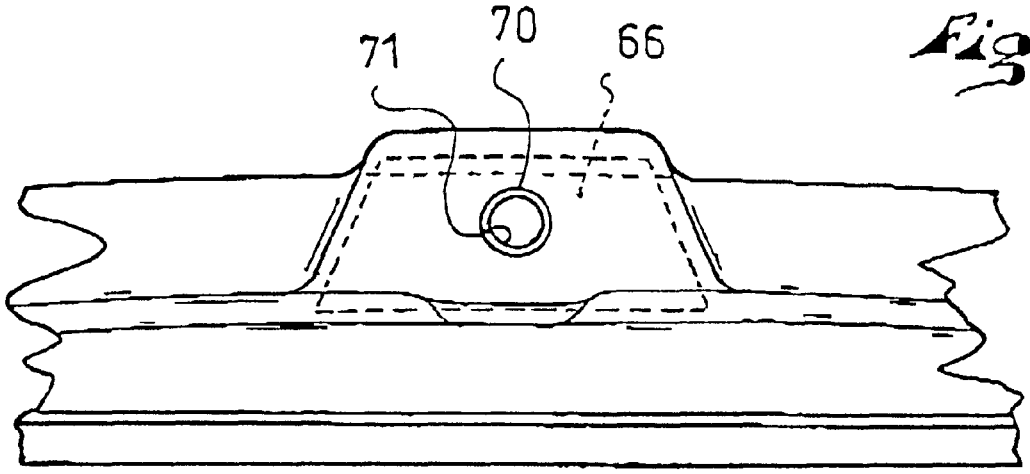
FIG. 7 is a partial side view of the ski of FIG. 6.

According to the alternative embodiment shown in FIGS. 6 and 7, instead of being widened in the zone of the through housings, the secondary core 65 has a uniform width with the remainder of the core in this zone. It is covered by a rider 66 which straddles the secondary core and whose lateral lugs rest on the metallic reinforcing layer 67 which covers the main core 68.

The rider is made of any appropriate material, for example, a plastic material such as a fiber-reinforced polyamide.

The housing 70 extends through the lugs of the rider 66 as well as the secondary core 65.

As in the preceding case, reinforcing layers 72 and 73 cover the cores 65 and 68, as well as the rider 66.

Optionally, an insert 71 is housed in the housing 70.

In these conditions, the transverse journal that connects the ski to the interface device bears on the lugs of the rider and the secondary core. The lugs of the rider ensure a more direct transmission of the skier's supports toward the running edges. The secondary core with the reinforcing layers of the ski ensure the vertical retention of the journal.

Figure 8:
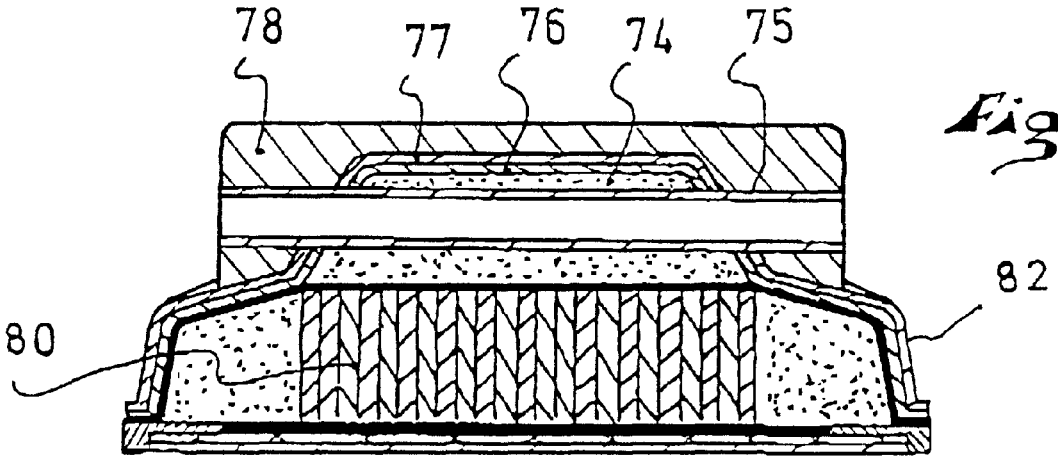
FIGS. 8 and 9 relate to another alternative embodiment.
Figure 9:
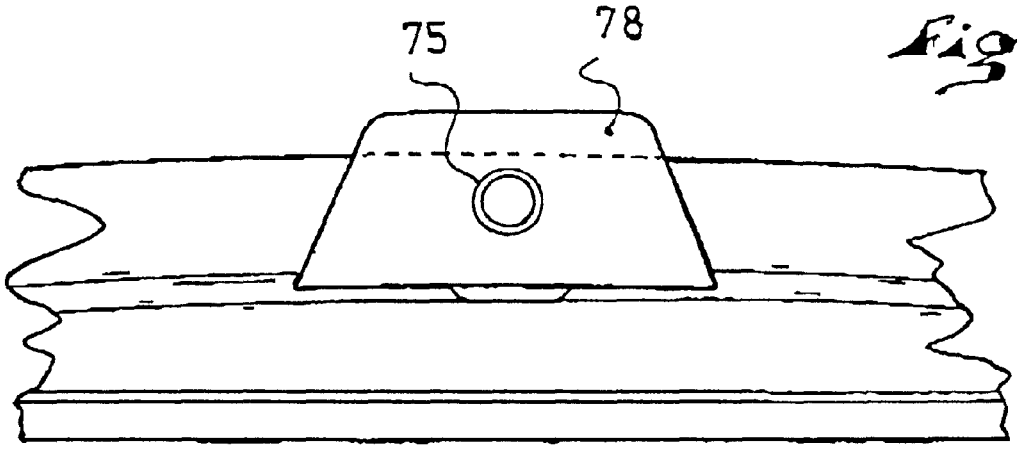

FIGS. 8 and 9 relate to another alternative embodiment. As in the preceding case, the secondary core 74 has a uniform width in the area of the through housings 75. Contrary to the preceding case, the reinforcing layers 76 and 77 directly cover the secondary core in this zone, and the rider 78 straddles the secondary core above these reinforcing layers. The rider is assembled to the ski by any appropriate means, and in particular by gluing or welding.

Its lugs rest on the reinforcing layers on each side of the rib, i.e., on the lower beam 82 of the ski.

As in the preceding case, the housing 75 extends through the lugs of the rider and the secondary core 74.

The lugs ensure a more direct transmission of the skier's supports toward the running edges.

This alternative embodiment offers the advantage that the secondary core is simpler to obtain and easier to cover with the upper reinforcing layers.

The invention can be made with all the materials and according to all the techniques known to the person with ordinary skill in the art.

The invention is not limited to the particular examples of embodiments described and shown.

In particular, different shapes can be provided for the rib. Different structures can also be provided for the cores.

What is claimed is:

1. A ski for alpine skiing, said ski comprising:

a longitudinal beam having front and rear ends and a central zone, the beam being formed by a main core covering a running surface, a stack of gliding and reinforcing layers with two lateral running edges, the main core being covered by a layered stack comprising at least reinforcing layers;

in the central zone, a secondary core being is superposed and supported on the main core so as to form, in the central zone, a projecting rib having a reduced width relative to a width of the ski, said rib having two transverse through housings;

at least one reinforcing layer in the central zone, the secondary core being located under said reinforcing layer.

2. A ski according to claim 1, wherein the layered stack covering the main core includes one or more decorating layers.

3. A ski according to claim 1, wherein the reinforcing layers include a metallic reinforcing layer covering the main core, and wherein the secondary core rests on said metallic reinforcing layer.

4. A ski according to claim 1, wherein, said reinforcing layer is made of fibers and extends laterally along opposite sides of the ski down to the running edges.

5. A ski according to claim 1, wherein the main core is formed by a central wooden insert edged laterally with portions made of foam.

6. A ski according to claim 1, wherein the secondary core is made of foam.

7. A ski according to claim 1, wherein the ski has a predeterminate length, and wherein said rib has a length of between one-half and one-third of said predeterminate length of the ski.

8. A ski according to claim 1, wherein the width of the rib is locally increased in the area of the through housings.

9. A ski according to claim 1, wherein the secondary core is affixed to the longitudinal beam between said two transverse through housings.

10. A ski according to claim 8, wherein, in the zone of the through housings, a rider straddles the secondary core, the rider having lugs, and wherein the lugs of the rider rest on the main core.

11. A ski according to claim 8, wherein, in the zone of the through housings, a rider straddles the rib, the rider having lugs, and wherein the lugs of the rider rest on the lower beam of the ski.

12. A skiing assembly comprising:

a ski for alpine skiing, said ski comprising:

a longitudinal beam having front and rear ends and a central zone, the beam comprising a main core, a plurality of layers, and two lateral running edges;

said plurality of layers comprising a running layer beneath the main core, and at least a plurality of reinforcing layers positioned above the main core;

in the central zone, a secondary core being superposed and supported on the main core so as to form, in the central zone, a projecting rib having a reduced width relative to a width of the ski, said secondary core being positioned beneath at least one of said plurality of reinforcing layers;

a plate positioned on said ski, said plate having front and rear mounting plates provided to receive front and rear retaining elements; and transverse journals traversing the rib and connecting said front and rear mounting plates to the rib.

13. A skiing assembly according to claim 12, further comprising said front and rear retaining elements connected to the ski by said two transverse journals.

14. A skiing assembly according to claim 12, wherein the plate has two lateral flanges which descend along the lateral surfaces of the rib, and wherein the journals extend transversely through said two flanges.

15. A ski according to claim 12, wherein, said transverse journals comprise two transverse through housings extending through said rib.

16. A skiing assembly according to claim 12, wherein the secondary core rests on one of said plurality of reinforcing layers positioned above the main core.

17. A skiing assembly according to claim 12, wherein said secondary core is affixed to said longitudinal beam between said transverse journals.

18. A gliding board comprising:

a front end, a rear end, and a longitudinally extending central zone, said central zone being spaced longitudinally from both said front and rear ends;

a longitudinally extending main core extending through said central zone and forwardly and rearwardly of said central zone;

at least one reinforcement layer covering said main core;

a longitudinally extending rib, said rib comprising a secondary core contained longitudinally within said central zone, said secondary core being supported by said reinforcement layer at opposite longitudinal ends of said secondary core and along a length of said secondary core between said ends of said secondary core;

said secondary core having a width less than a width of said main core throughout a length of said rib;

at least one reinforcement layer covering said secondary core; and two longitudinally spaced journal housings positioned within said rib.

19. A gliding board according to claim 18, wherein:

both said main core and said secondary core at least include a foam material.

20. A gliding board according to claim 18, further comprising:

at least a second reinforcement layer positioned above said secondary core and extending downwardly laterally of both said secondary core and said main core.

21. A gliding board assembly comprising a gliding board according to claim 18, further comprising:

two longitudinally spaced mounting plates for supporting boot bindings; and respective journals for connecting said mounting plates to said rib at said journal housings.

22. A gliding board according to claim 18, wherein said secondary core is supported by said main core between said two longitudinally spaced journal housings.

23. A gliding board comprising:

a front end, a rear end, and a longitudinally extending central zone, said central zone being spaced longitudinally from both said front and rear ends;

a lower beam assembly comprising:

a longitudinally extending main core extending through said central zone and forwardly and rearwardly of said central zone, said main core comprising a foam material;

at least one reinforcement layer covering said main core;

a longitudinally extending rib projecting upwardly from said lower beam assembly, said rib being integrated, along a length of said rib, to said lower beam, said rib comprising a secondary core contained longitudinally within said central zone of the gliding board, said secondary core comprising a foam material;

at least a second reinforcement layer positioned above said secondary core and extending downwardly laterally of both said secondary core and said main core.

24. A gliding board assembly comprising a gliding board according to claim 23, further comprising:

two longitudinally spaced mounting plates for supporting boot bindings; and respective journals for connecting said mounting plates to said rib at said journal housings.

25. A gliding board according to claim 23, wherein said secondary core is supported on said reinforcement layer covering said main core.

26. A gliding board according to claim 23, wherein said secondary core is affixed to said longitudinal beam between said transverse journals.

* * * * *